US005799833A

United States Patent [19]

Green et al.

[11] Patent Number: 5,799,833

[45] Date of Patent: Sep. 1, 1998

[54] GERMICIDE DISPENSING SYSTEM

[75] Inventors: Thomas S. Green, Atwater; Eric G. Hilston, Streetsboro, both of Ohio

[73] Assignee: ABC Dispensing Technologies, Akron, Ohio

[21] Appl. No.: 666,143

[22] Filed: Jun. 19, 1996

[51] Int. Cl.[6] ..... B67D 5/08

[52] U.S. Cl. ..... 222/135; 222/67; 222/145.1; 222/334; 222/425; 222/484

[58] Field of Search ..... 222/57, 129.3, 222/134, 135, 145.1, 145.5, 145.6, 145.7, 334, 64, 65, 67, 425, 484, 485

[56] References Cited

U.S. PATENT DOCUMENTS

| | | | |
|---|---|---|---|
| 2,791,353 | 5/1957 | Dorn et al. | 222/485 |
| 3,237,808 | 3/1966 | Witt et al. | 222/64 |
| 3,308,991 | 3/1967 | Glassey | 222/57 |
| 3,420,409 | 1/1969 | Petyt et al. | 222/134 |
| 3,804,297 | 4/1974 | Jurjans | 222/64 |
| 4,019,652 | 4/1977 | Suh et al. | 222/135 |
| 4,362,033 | 12/1982 | Young | 222/64 |
| 4,651,788 | 3/1987 | Grosskreuz et al. | 222/485 |
| 5,605,252 | 2/1997 | Owen et al. | 222/145.1 |

*Primary Examiner*—J. Casimer Jacyna

*Attorney, Agent, or Firm*—Renner, Kenner, Greive, Bobak, Taylor & Weber

[57] ABSTRACT

A fluid composition dispensing system employs a pair of bulk supplies of fluid components which communicate through air-actuated pumps to measurement and dispensing reservoirs. Each of the reservoirs has an associated float switch which is operative to inhibit operation of the associated pump when the reservoir is filled with a desired quantity of fluid component. A dispensing valve assembly is interposed between the two reservoirs to allow for dispensing from the reservoir at predetermined dispensing rates. A mechanical valve assembly has a linkage which is configured to allow the slower flowing fluid to pass through a larger valve orifice such that the dispensing rates of the two fluids are the same.

6 Claims, 1 Drawing Sheet

GERMICIDE DISPENSING SYSTEM

TECHNICAL FIELD

The invention herein resides in the art of fluid composition dispensing systems and, more particularly, to a dispensing system for appropriately dispensing the ingredients of a liquid germicide employed for application to cow udders and teats prior to milking. Specifically, the invention relates to a fluid composition dispensing system in which predetermined volumes of various components can be dispensed into a measurement reservoir and subsequently dispensed into a receptacle such that the final fluid composition contains components of exacting proportions.

BACKGROUND ART

Many fluids are a composition of various components, mixed to exacting standards. Some fluids are of such a nature that it is most desirous to keep the components of the composition separate and apart until such time as it is desired to actually employ the fluid composition. Often times, the mixed composition has a limited shelf life or it may be corrosive or otherwise hazardous. Consequently, it is desirous to mix such fluid compositions only at the time they are needed and only in such quantities as are needed at the time.

It has previously been known to prepare a wash mixture for cow teats which is made from a composition of lactic acid and sodium chlorite. According to the prior art, the formulation was typically premixed in a container and then sprayed from the container onto the udders and teats. Premix of this cleaning solution or germicide has been found not only to be time-consuming, but has also been given to a low shelf life of the mixed solution. While lactic acid and sodium chlorite separately have extensive shelf lives, the shelf life of the mixed solution is quite short. This short shelf life, coupled with the cost of the solution itself, requires that only the exact amounts of the solution necessary be mixed at any point in time to minimize loss due to waste. Additionally, the final wash is extremely corrosive, requiring implementation in a costly, stainless steel system. Even utilizing such apparatus, corrosion is found to take its toll.

The germicide which is prepared from the combination of lactic acid and sodium chlorite may also be used as a dip. The solution is contained in a small cup which is brought upwardly beneath each of the cow teats to be separately immersed in the solution of the container. Accordingly, it is desirous that the solution be capable of being generated in a dairy barn on an as-needed basis. Moreover, since the mixture typically comprises a 1:1 ratio of lactic acid to sodium chlorite, it is desirous that a highly reliable apparatus for generating such a mixture be adapted for barn use.

DISCLOSURE OF INVENTION

In light of the foregoing, it is a first aspect of the invention to provide a fluid composition dispensing system which allows for a highly accurate generation of a mix of fluid components on an as-needed basis.

Another aspect of the invention is the provision of a fluid composition dispensing system which is particularly adapted to generating a fluid germicide for use in treating cow teats prior to milking.

Yet another aspect of the invention is the provision of a fluid composition dispensing system in which the components of the fluid composition are kept separate and apart until needed, and then mixed in such a quantity as to fill a present need.

Still a further aspect of the invention is the provision of a fluid composition dispensing system which dispenses the various fluid components at the same rate, irrespective of the viscosity or natural flow rates of the components.

Still a further aspect of the invention is to provide a fluid composition dispensing system which is reliable and durable in use, easy to construct and operate, and adaptable for use not only with cow teat germicides, but any of numerous fluid compositions.

The foregoing and other aspects of the invention which will become apparent as the detailed description proceeds are achieved by a fluid composition dispensing system, comprising: a plurality of bulk supplies of fluid components of a fluid composition; a plurality of measuring and dispensing reservoirs in communication with said bulk supplies; first means interposed between said bulk supplies and said measuring and dispensing reservoirs for controlling passage of measured volumes of said fluid components into said measuring and dispensing reservoirs; and second means interconnecting said plurality of measuring and dispensing reservoirs for commonly dispensing said fluid components.

Other aspects of the invention which will become apparent herein are attained by apparatus for measuring and dispensing fluid compositions, comprising: first and second bulk supplies of fluid components; first and second measuring and dispensing reservoirs connected to said bulk supplies for receiving said fluid components therefrom, first means interposed between said bulk supplies and said reservoirs for selectively passing controlled volumes of said fluid components from said bulk supplies to respectively associated ones of said reservoirs; and second means interconnecting said reservoirs for concurrently dispensing said fluid components from said reservoirs.

BRIEF DESCRIPTION OF DRAWING

For a complete understanding of the objects, techniques, and structure of the invention reference should be made to the following detailed description and accompanying drawing wherein.

BEST MODE FOR CARRYING OUT THE INVENTION

Figure 1:
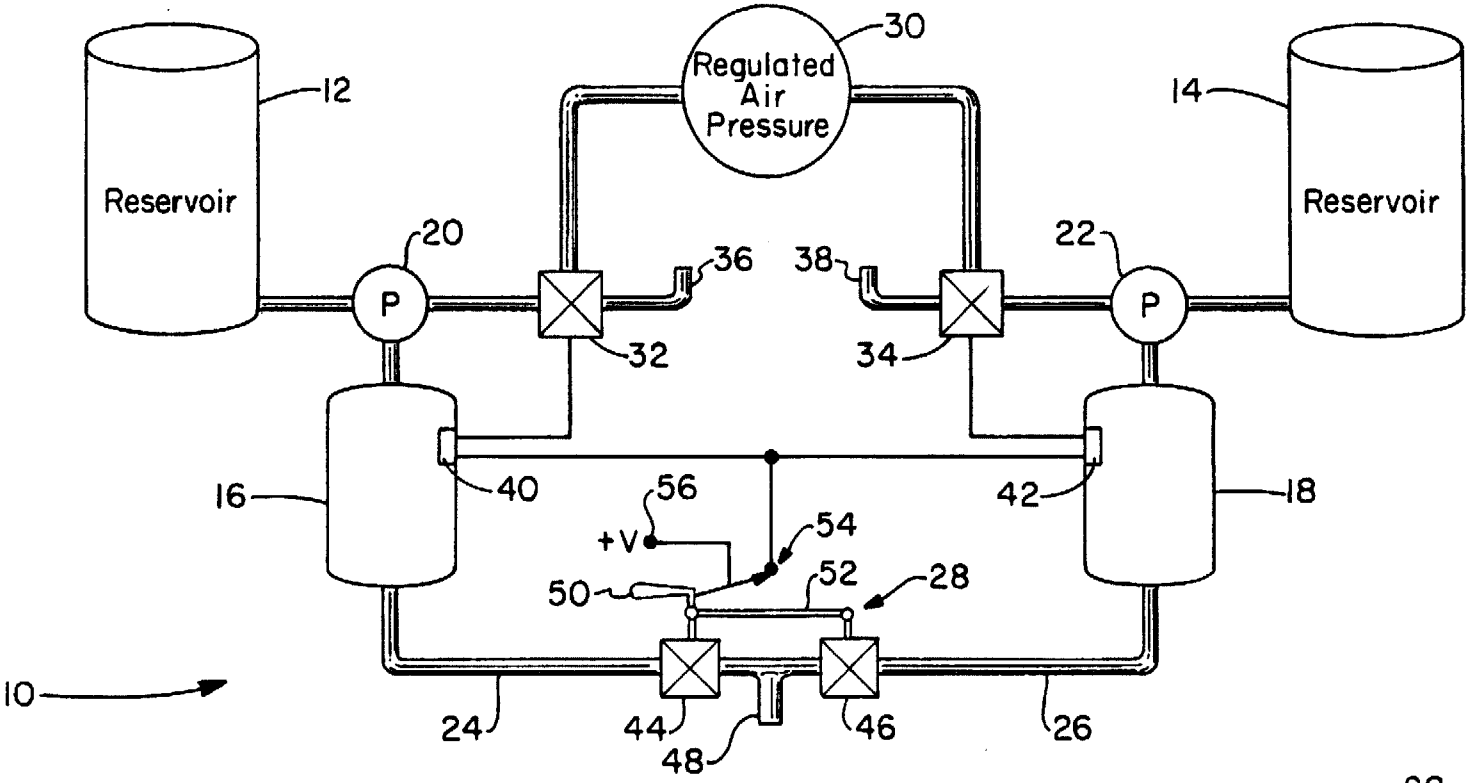
FIG. 1 is a schematic diagram of the fluid composition dispensing system of the invention.

Referring now to the drawing and more particularly FIG. 1, it can be seen that a dispensing system according to the invention is designated generally by the numeral 10. While it will be appreciated that the concept of the invention is adapted for dispensing a fluid composition which is comprised of any of a number of fluid components, the invention herein will be described with respect to such a system employing two fluid components—such as lactic acid and sodium chlorite for the manufacture of a germicide. In the system 10, two bulk supplies 12, 14 such as tanks or the like are so provided, each containing a different component. In selective communication with the bulk supplies 12, 14 are respective measuring and dispensing reservoirs 16, 18. Interposed between the bulk supplies 12, 14 and the reservoirs 16, 18 are respective air-actuated pumps 20, 22. While the preferred embodiment of the invention teaches the use of air-actuated pumps, it will be appreciated that such pumps might be electromechanical or may even be replaced by gravity feed through a valve system.

The measuring and dispensing reservoirs 16, 18 contain at the bottom thereof dispensing conduits 24, 26 which pass through a dispensing valve assembly 28, which will be described in detail later herein.

A source of regulated air pressure 30 is provided to power the system 10 and is adapted to selectively communicate with and activate the pumps 20, 22 through respectively associated three-way valves 32, 34. Each of the valves has an associated vent 36, 38 to atmosphere. Those skilled in the art will readily appreciate that each of the three-way valves 32, 34 is adapted to interconnect the associated pumps 20, 22 with the source of regulated air pressure 30, thus enabling the pump, or to vent the pump to atmosphere, thus disabling or inhibiting it.

A float switch 40, 42 is associated with each of the reservoirs 16, 18 and is so positioned so as to close when the volume of the fluid or liquid in the reservoir 16, 18 reaches a desired level. When preparing a germicide made from a 1:1 ratio of lactic acid and sodium chlorite, it will be understood that float switches 40, 42 would be set to close when each reservoir contained the same volume. Moreover, the specific volumes to be received in the reservoirs 16, 18 upon closure of the switches 40, 42 will also be determined by the total volume of fluid to be dispensed.

It will be further appreciated by those skilled in the art that the dispensing valve assembly 28 enables and disables the switches 16, 18. As will become apparent below, the dispensing valve assembly 28 is operative to apply electrical power to the float switches 40, 42 such that upon closure of those switches, power is applied to the associated three-way valves 32, 34 to vent the associated motor 20, 22 to atmosphere and thus terminate its operation.

With specific reference to the dispensing valve assembly 28, it will be appreciated that such assembly comprises manual dispensing valves 44, 46 respectively interposed in the dispensing conduits 24, 26. On the downstream side of each of the valves 44, 46 is a dispensing nozzle 48 which effectively combines the dispensing conduits 24, 26, as illustrated. A handle 50 interconnects the dispensing valves 44, 46 through a dispensing leakage 52, as will be discussed below. Suffice it to say at this time that actuation of the handle 50 simultaneously opens each of the valves 44, 46 and opens the same to such a degree that the rate of flow of the components from each of the reservoirs 16, 18 out of the dispensing nozzle 48 is the same.

The dispensing valve assembly 28 also includes a switch 54 which is interposed between a DC power supply 56 and the float switches 40, 42. The switch 54 is closed when the handle 50 is in the position that closes the valves 44, 46. At that time, power passes from the power supply 56, through the switch 54, and to appropriate contacts of the float switches 40, 42 where it is applied to the associated three-way valves 32, 34 until such time as the associated reservoir 16, 18 has an appropriate amount of fluid component therein, at which time the associated float switch 40, 42 opens, switching the associated three-way valve 32, 34 to vent the associated pump 20, 22 to atmosphere. Accordingly, it will be appreciated that when the handle 50 is rotated to open the dispensing valves 44, 46, no power is applied to the switches 40, 42 and, accordingly, the pumps 20, 22 are vented and the reservoirs 16, 18 cannot be filled. As a consequence, the filling and dispensing operations respecting the reservoirs 16, 18 are mutually exclusive.

Those skilled in the art will readily appreciate that various fluid components have different flow rates. A part of this is simply the result of different viscosities, although other factors impact these flow rates, as well. In any event, it is most desirable that the dispensing system 10 be capable of dispensing the fluid components from the reservoirs 16, 18 at the same rate, to assure the desired 1:1 ratio at the dispensing nozzle 48, as well as in the receptacle into which the fluid composition is ultimately passed. Of course, if the composition is other than a 1:1 ratio, it would be desired to adjust the valves 44, 46 to assure that the desired flow rate ratio is maintained.

Figure 2:
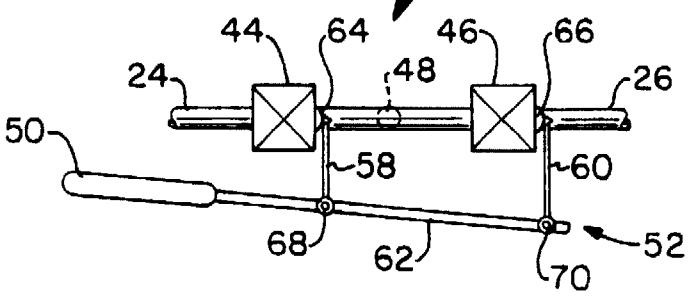
FIG. 2 is an illustrative top plan view of the dispensing valve assembly according to the invention.

With reference now to FIG. 2, it can be seen that in a system where one of the fluid components has a greater flow rate than the other, and when it is desired that the actual dispensing rate be at a 1:1 ratio, the degree to which the associated dispensing valves 44, 46 are opened may be modified to assure the desired dispensing rates. In FIG. 2, the dispensing valve assembly 28 is shown as consisting of an actuating arm 58 which is slightly shorter than the actuating arm 60, such actuating arms being respectively interconnected with the valves 44, 46. A transverse arm 62 extends from the handle 50 and interconnects the short actuating arm 58 and the longer actuating arm 60, as illustrated. The arm 58 connects with the valve 44 through a fixed pivot 64. Similarly, the long actuating arm 60 interconnects with the dispensing valve 46 through a fixed pivot 66. The opposite ends of the actuating arms 58, 60 are connected to the transverse link 62 by means of moving pivots 68, 70, respectively. Those skilled in the art will readily appreciate that when the handle 50 is pulled, the valve 44, connected to the shorter actuating arm 58, will open a greater degree than the valve 46 which is connected to the longer actuating arm 60. Accordingly, the slower flowing fluid maintained in reservoir 16 will be allowed to flow at the same rate as the faster flowing fluid contained in the reservoir 18 if the orifice defined by the respective valves 44, 46 is appropriately established. This establishment is attained by the relative lengths of the actuating arms 58, 60. Accordingly, as the composition is dispensed from the nozzle 48, it is dispensed at a 1:1 ratio into the receiving receptacle and stratification or any likelihood that a 1:1 ratio is not achieved because of early termination of the dispensing cycle is eliminated.

In operation, when it is desired to dispense a fluid composition, the handle 50 is actuated, opening the switch 54 and removing power from the float switches 40, 42. Movement of the handle 50 further opens the valves 40, 46 such that dispensing of a desired ratio (in this case 1:1) is attained. The handle 50 is held open until both of the reservoirs 16, 18 are drained, at which time the handle 50 may either be rotated in an opposite direction to close the valves 44, 46, or a return spring may be employed for that purpose. Immediately upon return of the handle 50 to the closed valve position, the switch 54 is closed, applying DC power (preferably 24 volts) to the float switches 40, 42. With the reservoirs 16, 18 being empty, the float switches 40, 42 are closed to thereby apply power to the three-way valves 32, 34 which switch to interconnect the regulated air pressure source 30 with the pumps 20, 22. These pumps cause fluid component to pass from the associated bulk supply 12, 14 into the associated reservoirs 16, 18 until such time as the associated float switch 40, 42 reaches the set level at which it opens, disconnecting power from the associated three-way valves 32, 34, thus terminating operation of the associated pump 20, 22. After operation of both pumps 20, 22 has ceased, the reservoirs 16, 18 contain the appropriate amount of component for a subsequent dispensing cycle.

It will be readily appreciated by those skilled in the art that the concept of the invention may be employed using solenoid actuated valves, rather than mechanical valves as illustrated. It will also be appreciated that a 1:1 ratio need not be employed, but that the valves may be controlled to achieve any desired dispensing ratio. Moreover, any of a number of components may be simultaneously dispensed, not just the two illustrated in the preferred embodiment. Accordingly, those skilled in the art will readily appreciate that the concept of the invention may be expanded to any of various ratios and any of various compositions.

Thus it can be seen that the objects of the invention have been satisfied by the structure presented above. While in accordance with the patent statutes only the best mode and preferred embodiment of the invention has been presented and described in detail, it will he understood that the invention is not limited thereto or thereby. Accordingly, for an appreciation of the true scope and breadth of the invention reference should be made to the following claims.

What is claimed is:

1. A fluid composition dispensing system, comprising:

a plurality of bulk supplies of fluid components of a fluid composition;

a plurality of measuring and dispensing reservoirs in communication with said bulk supplies;

first means interposed between said bulk supplies and said measuring and dispensing reservoirs for controlling passage of measured volumes of said fluid components into said measuring and dispensing reservoirs;

second means interconnecting said plurality of measuring and dispensing reservoirs for commonly dispensing said fluid components;

wherein said second means comprises a dispensing conduit passing from each of said measuring and dispensing reservoirs to a dispensing nozzle, and a dispensing valve interposed in each said conduit, said dispensing valves are manually actuated by interconnection with a single handle, and a dispensing rate associated with each said dispensing valve is a function of a flow rate of an associated fluid component and the volume percentage of such component in said fluid consumption; and a linkage interposed between said valves and said handle, said linkage having an actuating arm engaging each valve, each such actuating arm having a length determinative of an amount an associated valve is opened when said handle is moved to an open position, said lengths of said actuating arm being a function of said flow rate and volume of an associated fluid component being dispensed.

2. The fluid composition dispensing system according to claim 1, wherein said actuating arms connect to associated valves at fixed pivots and to a transverse link at moving pivots.

3. The fluid composition dispensing system according to claim 1, wherein said first means comprises a level sensing switch in each said measuring and dispensing reservoir, and a valve interposed between said bulk supplies and associated measuring and dispensing reservoirs.

4. The fluid composition dispensing system according to claim 3, wherein said first means further comprises a pump interposed between each said bulk supply and said measuring and dispensing reservoirs, said valves interconnecting said pumps and actuating and deactivating said pumps under control of said level sensing switches.

5. The fluid composition dispensing system according to claim 4, wherein said pumps are air driven pumps and wherein said valves are interposed between said pumps and a source of air pressure.

6. The fluid composition dispensing system according to claim 4, wherein said second means interconnects with said level sensing switches and disables said switches when said fluid components are being dispensed.

* * * * *